US011139613B2

(12) United States Patent
Masumoto

(10) Patent No.: US 11,139,613 B2
(45) Date of Patent: Oct. 5, 2021

(54) CONNECTOR ASSEMBLY WITH AUTOMATIC CONNECTION COMPLETION DETECTION STRUCTURE

(71) Applicant: Sumitomo Wiring Systems, Ltd., Mie (JP)

(72) Inventor: Takuya Masumoto, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/821,956

(22) Filed: Mar. 17, 2020

(65) Prior Publication Data

US 2020/0303876 A1 Sep. 24, 2020

(30) Foreign Application Priority Data

Mar. 20, 2019 (JP) ..... JP2019-052639

(51) Int. Cl.
*H01R 13/631* (2006.01)
*H01R 13/627* (2006.01)
*H01R 13/502* (2006.01)

(52) U.S. Cl.
CPC ..... *H01R 13/631* (2013.01); *H01R 13/502* (2013.01); *H01R 13/6272* (2013.01)

(58) Field of Classification Search
CPC ..... H01R 13/631; H01R 13/502; H01R 13/6272; H01R 13/62933; H01R 13/62938
USPC ..... 439/372
See application file for complete search history.

(56) References Cited

U.S. PATENT DOCUMENTS 3,030,601 A * 4/1962 Krebs ..... H01R 13/6392 439/369
3,344,393 A * 9/1967 Hendee ..... H01R 13/6392 439/369
4,940,424 A * 7/1990 Odbert ..... H01R 13/6392 439/314
5,259,782 A * 11/1993 Giffin ..... H01R 13/6392 439/314
5,397,859 A * 3/1995 Robertson ..... H01R 4/70 174/92
5,561,269 A * 10/1996 Robertson ..... H01R 4/70 174/92
5,569,882 A * 10/1996 Yokoyama ..... H02G 15/003 174/138 F (Continued)

FOREIGN PATENT DOCUMENTS

JP 10-223313 8/1998

*Primary Examiner* — Peter G Leigh
(74) *Attorney, Agent, or Firm* — Gerald E. Hespos; Michael J. Porco; Matthew T. Hespos

(57) ABSTRACT

It is aimed to guarantee the connection of a connector by completing the assembling of a cover. A connector (10) of the present disclosure includes a first connector (20), a second connector (30) and a cover (40). The first connector (20) and the second connector (30) are connectable to each other and completely covered by the cover (40) in a completely connected state. The cover (40) includes a first cover (41) for accommodating the first connector (20) inside and a second cover (42) for accommodating the second connector (30) inside. The second cover (41) includes a pair of openable and closable second half covers (42U, 42L). The half cover (42U, 42L) includes a connection guaranteeing portion for coming into contact with the second connector (30) in the completely connected state from behind.

8 Claims, 6 Drawing Sheets

(56) References Cited

U.S. PATENT DOCUMENTS

| | | | | | |
|---|---|---|---|---|---|
| 5,755,588 | A * | 5/1998 | Sweatman | H01R 13/6392 | 439/369 |
| 5,893,772 | A * | 4/1999 | Carmo | H01R 13/639 | 439/346 |
| 5,984,687 | A * | 11/1999 | Schwarz | H01R 39/643 | 439/17 |
| 5,997,342 | A | 12/1999 | Suzuki | | |
| 6,280,235 | B1 * | 8/2001 | Radliff | H01R 13/501 | 439/456 |
| 6,454,576 | B1 * | 9/2002 | Hedrick | H01R 13/5812 | 439/105 |
| 6,602,087 | B1 * | 8/2003 | Carle | H01R 13/53 | 439/367 |
| 7,001,202 | B2 * | 2/2006 | Robbins | H01R 13/625 | 439/367 |
| 7,141,738 | B2 * | 11/2006 | Marsac | G02B 6/4446 | 174/92 |
| 7,442,067 | B1 * | 10/2008 | Amaral | H01R 13/639 | 439/367 |
| 7,465,182 | B1 * | 12/2008 | McDonald | H01R 13/6392 | 439/369 |
| 7,553,181 | B1 * | 6/2009 | Van Dalinda, III | H01R 13/6392 | 174/92 |
| 8,063,306 | B2 * | 11/2011 | Zhong | H02G 15/046 | 174/92 |
| 8,870,587 | B2 * | 10/2014 | Nooner | H01R 13/52 | 439/367 |
| 9,012,774 | B2 * | 4/2015 | Simmons | H05K 5/061 | 174/50.5 |
| 9,413,101 | B1 * | 8/2016 | Nooner | H01R 13/5208 | |
| 9,653,837 | B2 * | 5/2017 | Nooner | H01R 13/5219 | |

* cited by examiner

CONNECTOR ASSEMBLY WITH AUTOMATIC CONNECTION COMPLETION DETECTION STRUCTURE

BACKGROUND

Field of the Invention

The disclosure relates to a connector.

Related Art

Japanese Unexamined Patent Publication No. H10-223313 discloses a connector connection detection structure capable of detecting incomplete connection of a connector by an opening/closing operation of a cover. The connector connection detection structure includes a female connector and two covers, and the covers include pressing inclined walls. In the case of incomplete connection, the pressing inclined walls press a rear step of a male connector so that the male connector is pushed into the female connector. The covers can be closed while this pushing state is confirmed visually from outside.

However, a connected state cannot be confirmed visually from outside if the male and female connectors are covered completely by the covers. Thus, it is necessary to remove the covers, make a transition from an incompletely connected state to a completely connected state and assemble the covers again if the incompletely connected state is noticed after the covers are assembled.

SUMMARY

This disclosure is directed to a connector with a first connector, a second connector and a cover. The first and second connectors are connectable to each other and are covered completely by the cover in a completely connected state. The cover includes a first cover for accommodating the first connector inside and a second cover for accommodating the second connector inside. The second cover includes two openable and closable half covers, and each half cover includes a connection guaranteeing portion for contacting the second connector from behind in the completely connected state.

The first and second connectors are covered completely by the cover and connection cannot be confirmed visually from outside. However, the completely connected state can be detected by the half covers being closed and the connection guaranteeing portion contacting the second connector from behind. Specifically, connection of the connector can be guaranteed by completing the assembling of the cover.

The second cover may extend in a connecting direction along an outer surface of the second connector, and the connection guaranteeing portion may include a protrusion projecting in a direction perpendicular to the connecting direction from an inner surface of the half cover. The outer shape of the second connector need not be enlarged in the direction perpendicular to the connecting direction and the connector can be reduced in size.

The protrusion may have an inclined surface for pushing the second connector in an incompletely connected state toward the first connector. Even if the second connector is in the incompletely connected state, a transition to the completely connected state can be made by pushing the second connector toward the first connector by the inclined surface.

According to the present disclosure, it is possible to guarantee the connection of a connector by completing the assembling of a cover.

DETAILED DESCRIPTION

Figure 1:
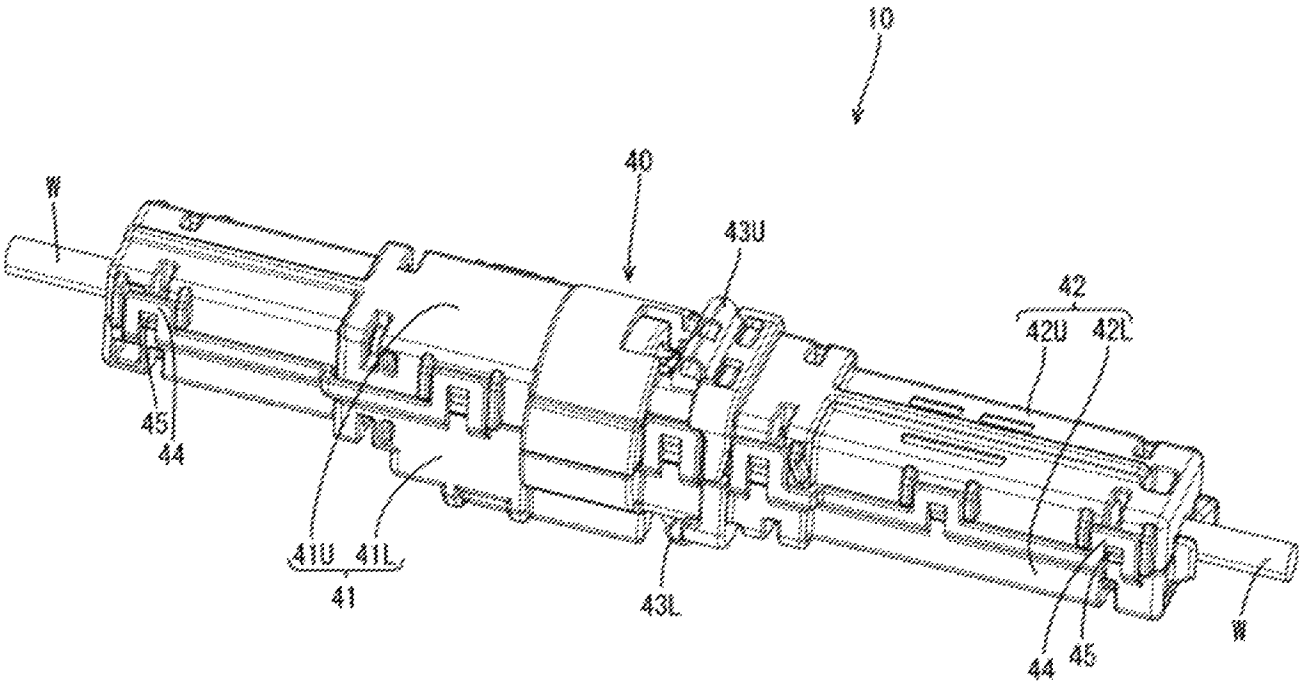
FIG. 1 is a perspective view of a connector viewed obliquely from above.

A specific example of a connector 10 of the present disclosure is described below with reference to the drawings. Note that the present disclosure is not limited to these illustrations and is intended to be represented by claims and include all changes in the scope of claims and in the meaning and scope of equivalents.

An embodiment is described with reference to FIGS. 1 to 6. The connector 10 of this embodiment includes a first connector 20, a second connector 30 and a cover 40, as shown in FIG. 3. The connector 10 is used in a suspension of a vehicle.

The first connector 20 includes a first housing 21 made of synthetic resin. The first housing 21 includes a hollow cylindrical receptacle 22, a cylindrical terminal holding portion 23 holding unillustrated terminals and a hollow cylindrical rubber plug accommodating portion 24 in this order from the front. An end of a wire W is connected to the unillustrated terminals. A rubber plug 25 is accommodated inside the rubber plug accommodating portion 24.

The second connector 30 includes a second housing 31 made of synthetic resin. The second housing 31 includes a cylindrical terminal holding portion 32 holding unillustrated terminals and a hollow cylindrical rubber plug accommodating portion 33 in this order from the front. An end of a wire W is connected to the unillustrated terminals. A rubber plug 34 is accommodated inside the rubber plug accommodating portion 33.

The receptacle 22 of the first housing 21 includes a large-diameter portion 22A and a small-diameter portion 22B. The large-diameter portion 22A has a larger diameter than the small-diameter portion 22B and is coaxial with the small-diameter portion 22B. The inside of the large-diameter portion 22A communicates with that of the small-diameter portion 22B.

A first flat surface 22C is provided in an upper part of the small-diameter portion 22B, and a second flat surface 32A is provided in an upper part of the terminal holding portion 32 of the second housing 31. The first and second housings 21, 31 are assembled in a rotational orientation so that the first and second flat surfaces 22C, 32A are in surface contact with each other. This surface contact of the first and second flat surfaces 22C, 32A restricts relative rotation of the connected first and second housings 21, 31.

The first flat surface 22C of the first housing 21 has a vertically displaceable lock 26. On the other hand, the second flat surface 32A of the second housing 31 has a locked portion 35. The lock 26 rides on the locked portion 35 and displaces up as the terminal holding portion 32 of the second housing 31 is being fit into the receptacle 22 of the first housing 21. The lock 26 rides over the locked portion 35 and displaces down when the terminal holding portion 32 is fit into the receptacle 22 so that the lock 26 and the locked portion 35 are locked to each other. In this way, the housings 21, 31 are held in a connected state.

A seal ring 27 is mounted inside the large-diameter portion 22A of the receptacle 22 and is sandwiched between the outer peripheral surface of the terminal holding portion 32 and the inner peripheral surface of the large-diameter portion 22A when the terminal holding portion 32 of the second housing 31 is fit into the receptacle 22 of the first housing 21. The seal prevents water from intruding through a fit part of the housings 21, 31 and into the receptacle 22.

The rubber plug 25 of the first housing 21 restricts intrusion of water into the terminal holding portion 23, and the rubber plug 34 of the second housing 31 restricts intrusion of water into the terminal holding portion 32. In this way, the intrusion of water into the first and second connectors 20, 30 is restricted.

Figure 2:
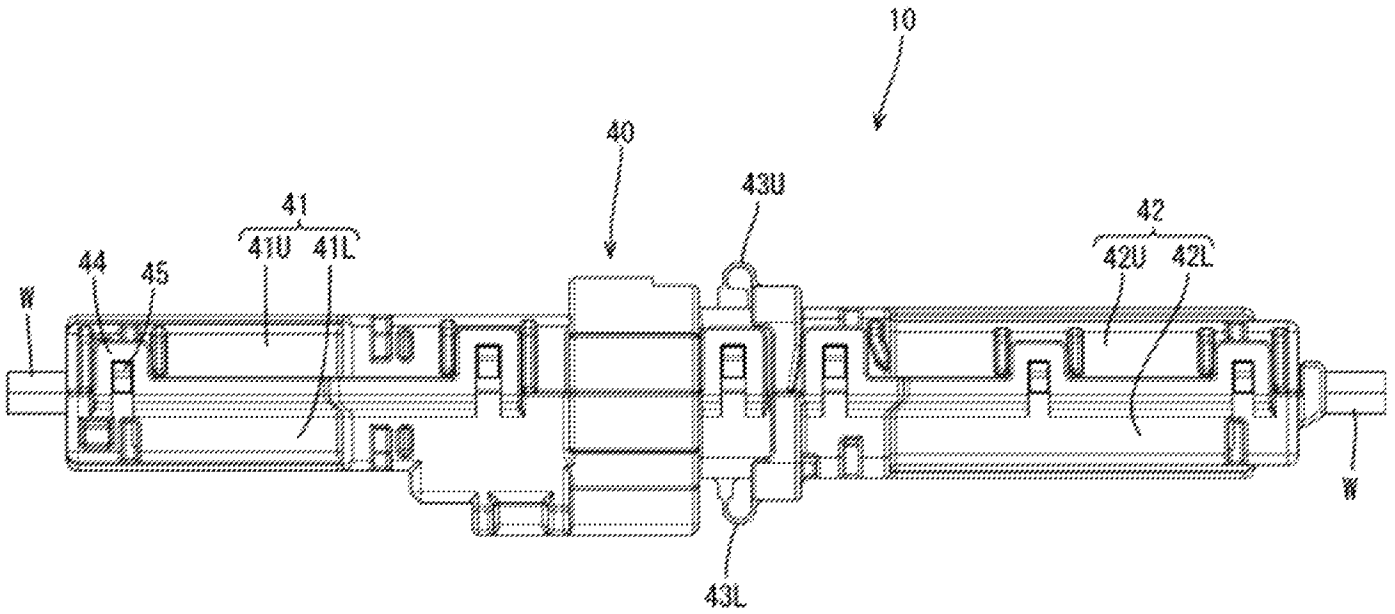
FIG. 2 is a side view of the connector in a state where half covers are closed.
Figure 3:
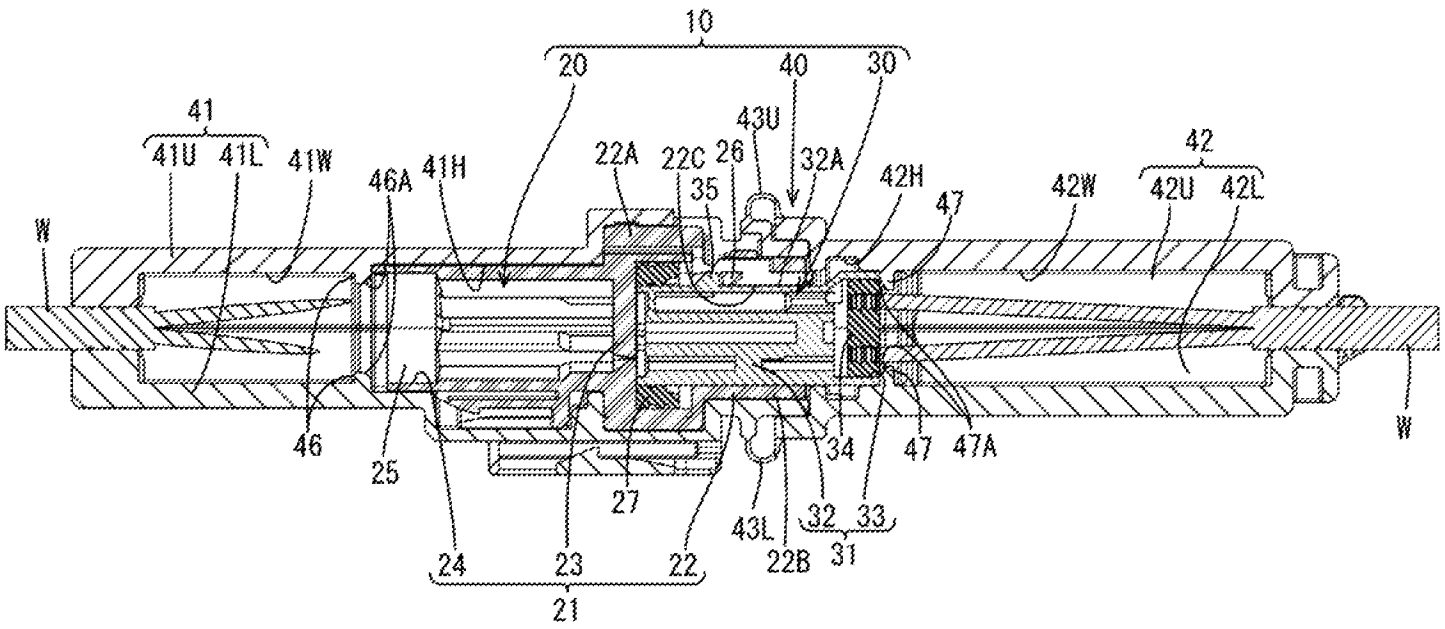
FIG. 3 is a section showing an internal structure of the connector in the state where the half covers are closed.

The cover 40 is made of synthetic resin and includes, as shown in FIGS. 1 and 2, a first cover 41 and a second cover 42. The first cover 41 covers the first connector 20, and the second cover 42 covers the second connector 30. The connector 10 is covered completely by the cover 40 and cannot be confirmed visually from outside.

The first cover 41 is formed by assembling upper and lower first half covers 41U, 41L, and the second cover 42 is formed by assembling upper and lower second half covers 42U, 42L. The upper first half cover 41U and the upper second half cover 42U are coupled by an upper hinge 43U and can open and close. The lower first half cover 41L and the lower second half cover 42L are coupled by a lower hinge 43L and can open and close. Thus, the upper and lower second half covers 42U, 42L are openable and closable with the first cover 41 closed.

Figure 4:
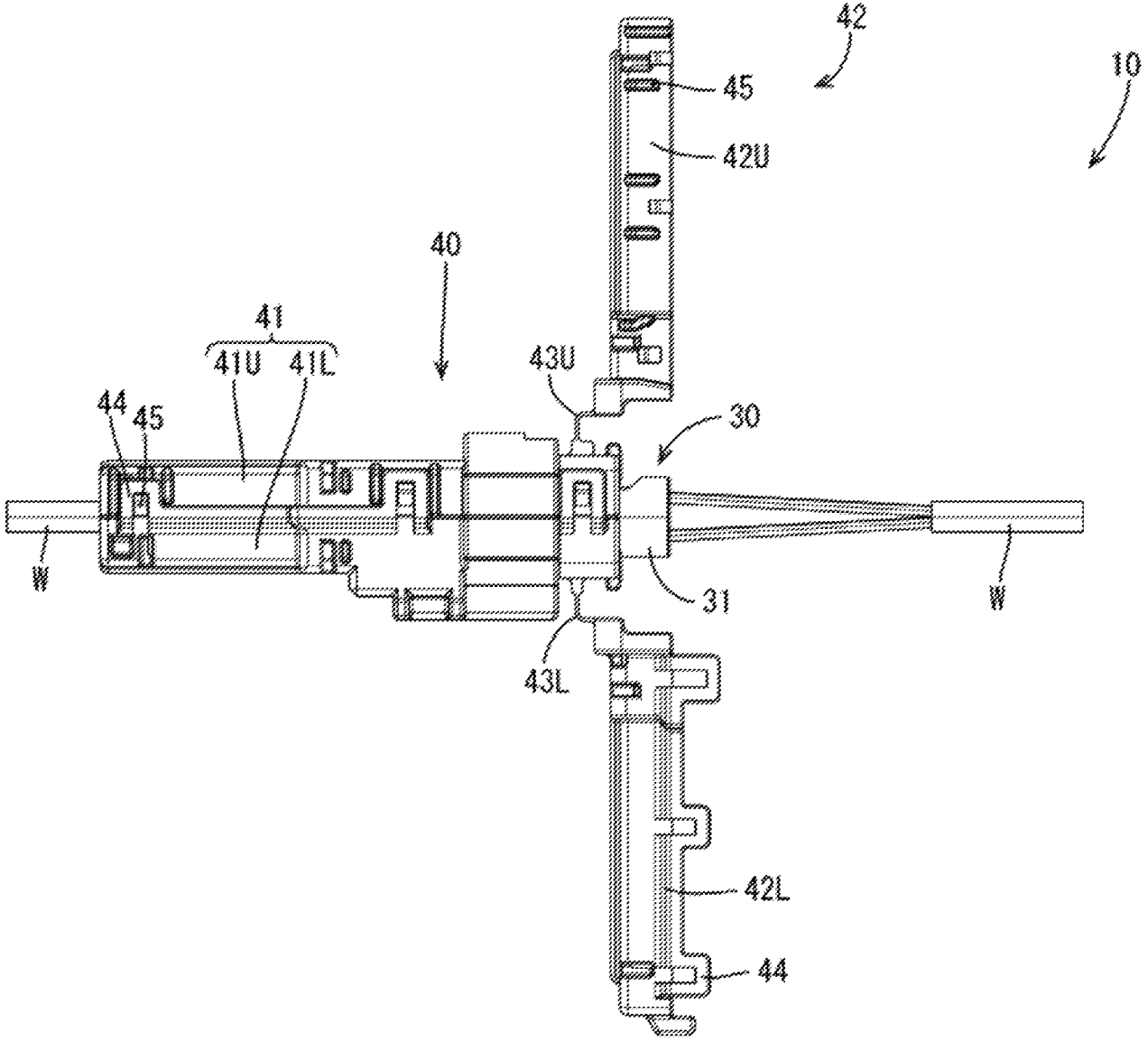
FIG. 4 is a side view of the connector in a state where the half covers are opened.

Cover lock pieces 44 are provided on side surfaces of the lower first half cover 41L and the lower second half cover 42L. On the other hand, lock receiving portions 45 are provided on side surfaces of the upper first half cover 41U and the upper second half cover 42U. As shown in FIG. 4, the upper and lower first half covers 41U, 41L are fixed integrally by locking the cover lock pieces 44 to the respective lock receiving portions 45 on the first cover 41. Subsequently, the upper and lower second half covers 42U, 42L are fixed integrally by locking the cover lock pieces 44 to the respective lock receiving portions 45 on the second cover 42.

As shown in FIG. 3, the first cover 41 extends in a connecting direction along the outer surface of the first connector 20. Thus, the outer shape of the first cover 41 need not be enlarged in a direction perpendicular to the connecting direction and the connector 10 can be small. The first cover 41 includes a first housing accommodating portion 41H for accommodating the first housing 21 inside and a first wire accommodating portion 41W for accommodating the wire W pulled out rearwardly of the first housing accommodating portion 41H inside. A length in the front-rear direction of the first housing accommodating portion 41H is equal to or somewhat shorter than that of the first wire accommodating portion 41W. Thus, even if the wire W is bent, the rubber plug 25 is unlikely to be deformed.

Upper and lower first protrusions 46 are between the first housing accommodating portion 41H and the first wire accommodating portion 41W. The first protrusions 46 extend in a circumferential direction along the outer peripheral surface of the first housing 21. The first housing 21 is fit between a front part of the first housing accommodating portion 41H and the first protrusions 46. Here, fitting includes a case where there is no clearance at all between the outer surface of the first housing 21 and the inner surface of the first housing accommodating portion 41H and a case where there is a tiny clearance. Thus, by accommodating the first housing 21 into the first housing accommodating portion 41H and locking the cover lock pieces 44 and the lock receiving portions 45 to each other, the first housing 21 is accommodated at a proper position in the first housing accommodating portion 41H.

The first protrusion 46 has a first inclined surface 46A inclined toward a radially outer side toward the front. If the first cover 41 is closed when the first housing 21 is deviated slightly rearward with respect to the proper position, the rear end of the first housing 21 contacts the first inclined surfaces 46A so that the first housing 21 is pushed forward to move to the proper position and the first cover 41 is closed.

The second cover 42 extend in the connecting direction along the outer surface of the second connector 30. Thus, the second cover 42 need not be enlarged in the direction perpendicular to the connecting direction and the connector 10 can be reduced in size. The second cover 42 includes a second housing accommodating portion 42H for accommodating the second housing 31 inside and a second wire accommodating portion 42W for accommodating the wire W pulled out rearwardly of the second housing accommodating portion 42H inside. A length in the front-rear direction of the second housing accommodating portion 42H is shorter than that of the second wire accommodating portion 42W. Further, the second wire accommodating portion 42W is about twice as long as the first wire accommodating portion 41W. Thus, even if the wire W is bent, the rubber plug 34 is not deformed and waterproof performance is not affected.

Figure 5:
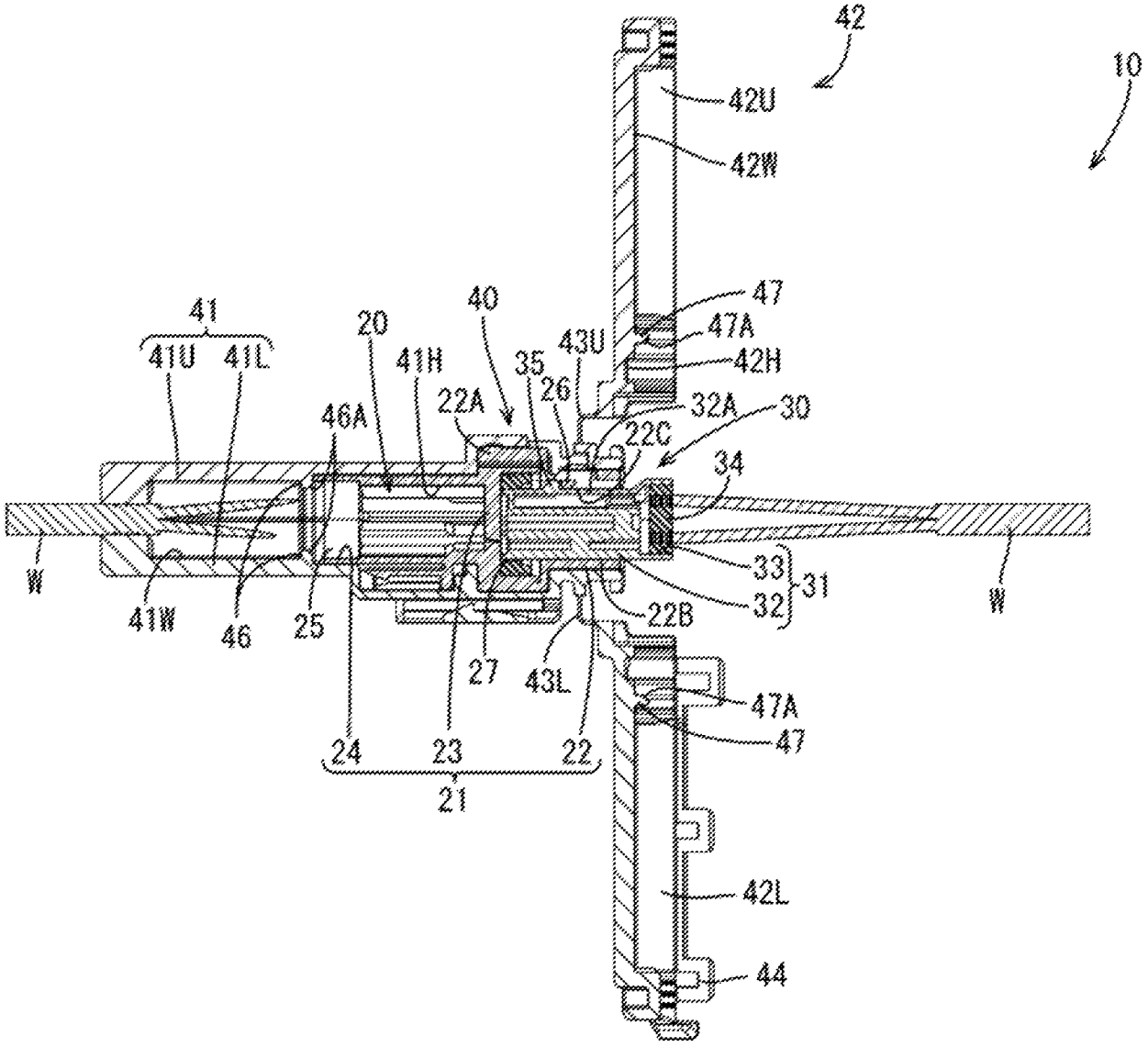
FIG. 5 is a section showing an internal structure of the connector in the state where the half covers are opened.

As shown in FIG. 5, in this embodiment, the second connector 30 is covered by the second cover 42 after the first connector 20 is covered by the first cover 41 so that the cover 40 completely covers the entire connector 10. With the second cover 42 opened, most of the second connector 30 is covered by the first cover 41 so that the connected state of the first and second connectors 20, 30 cannot be confirmed visually. Thus, an operation of closing the second cover 42 may be started without an incompletely connected state of the first and second connectors 20, 30 being noticed.

Accordingly, upper and lower second protrusions (connection guaranteeing portion) 47 are provided and contact the second connector 30 from behind in the completely connected state. The completely connected state means a state where the first and second connectors 20, 30 are connected properly and the lock 26 and the locked portion 35 are locked to each other.

The upper and lower second protrusions 47 are between the second housing accommodating portion 42H and the second wire accommodating portion 42W. The second protrusions 47 extend in the circumferential direction along the outer peripheral surface of the second housing 31. The second housing 31 is fit and accommodated between a front end of the second housing accommodating portion 42H and the second protrusions 47. Here, fitting includes a case where there is no clearance at all between the outer surface of the second housing 31 and the inner surface of the second housing accommodating portion 42H and a case where there is a tiny clearance. Thus, by accommodating the second housing 31 in the second housing accommodating portion 42H and locking the cover lock pieces 44 and the lock receiving portions 45 to each other, the second housing 31 is accommodated at a proper position in the second housing accommodating portion 42H. Simultaneously, it is guaranteed that the first and second connectors 20, 30 are in the completely connected state. Specifically, the connection of the connector 10 can be guaranteed by completing the assembling the second cover 42.

Figure 6:
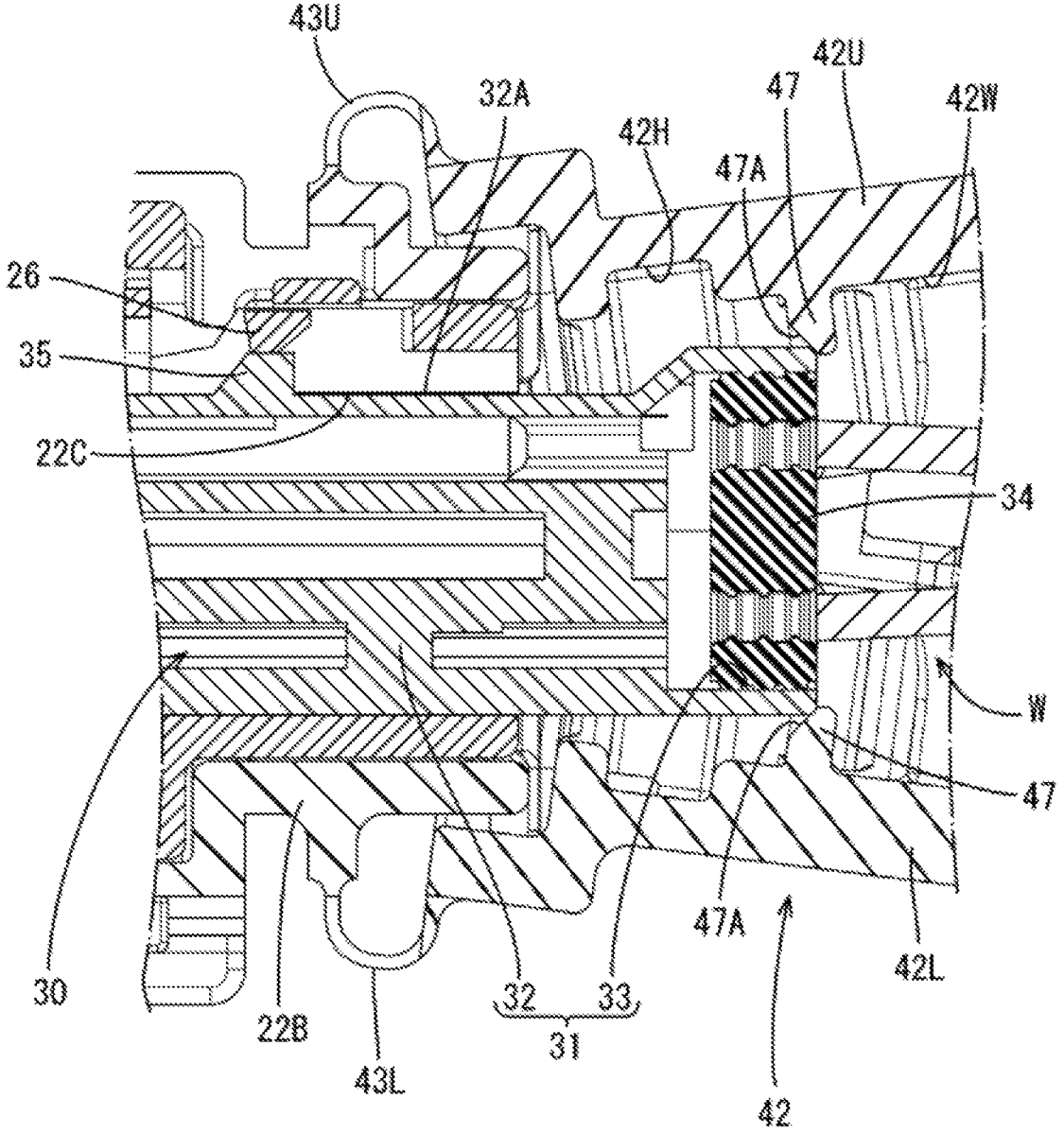
FIG. 6 is a section enlargedly showing the vicinity of two inclined surfaces in a state where the inclined surfaces push a second connector toward a first connector.

As shown in FIG. 6, the second protrusion 47 has a second inclined surface 47A inclined toward a radially outer side toward the front. If the second cover 42 is closed when the second housing 31 is deviated slightly rearward with respect to the proper position, the rear end of the second housing 31 contacts the second inclined surfaces 47A so that the second housing 31 is pushed forward to the proper position and the second cover 42 is closed. In this way, a transition can be made from the incompletely connected state to the completely connected state by pushing the second connector 30 toward the first connector 20.

OTHER EMBODIMENTS

Although the second protrusions 47 contact the rear end of the second housing 31 in the above embodiment, a projection may be provided on the outer peripheral surface of the second housing 31 and the second protrusions may contact this projection from behind.

Although the second protrusion 47 has the second inclined surface 47A in the above embodiment, the second protrusion may have a spherical tip.

The second protrusions 47 may resiliently contact the rear end of the second housing 31.

LIST OF REFERENCE SIGNS

10 connector
20 first connector
21 first housing
22 receptacle
22A large-diameter portion
22B small-diameter portion
22C first flat surface
23 terminal holding portion
24 rubber plug accommodating portion
25 rubber plug
26 lock
27 seal ring
30 second connector
31 second housing
32 terminal holding portion
32A second flat surface
33 rubber plug accommodating portion
34 rubber plug
35 locked portion
40 cover
41 first cover
41U, 41L first half cover
41H first housing accommodating portion
41W first wire accommodating portion
42 second cover
42U, 42L second half cover
42H second housing accommodating portion
42W second wire accommodating portion
43U upper hinge
43L lower hinge
44 cover lock piece
45 lock receiving portion
46 first protrusion
46A first inclined surface
47 second protrusion (connection guaranteeing portion)
47A second inclined surface
W wire

What is claimed is:

1. A connector assembly, comprising:
a first connector;
a second connector that is connectable to the first connector; and
a cover that completely covers the first connector and the second connector when the first and second connectors are in a completely connected state,
the cover includes a first cover for accommodating the first connector inside and a second cover for accommodating the second connector inside,
the second cover includes upper and lower half covers that are hinged respectively to spaced apart positions on the first cover and are rotatable between an open position where the second connector is exposed and a closed position where the second connector is covered, and
each of the half covers of the second cover includes a connection guaranteeing protrusion for contacting the second connector from behind in the completely connected state and for contacting a side surface of the second connector and preventing the second cover from completely covering the second connector when the first and second connectors are not in the completely connected state.

2. The connector assembly of claim 1, wherein the second cover extends in a connecting direction along an outer surface of the second connector, and the connection guaranteeing protrusions project perpendicular to the connecting direction from an inner surface of the respective half cover.

3. The connector assembly of claim 1, wherein each of the connection guaranteeing protrusions has an inclined surface for pushing the second connector in an incompletely connected state toward the first connector.

4. The connector assembly of claim 1, wherein the first cover includes upper and lower half covers that are connectable to one another for accommodating the first connector inside the first cover and between the upper and lower half covers of the first cover.

5. The connector assembly of claim 4, wherein the upper half cover of the second cover is hinged to the upper half cover of the first cover, and the lower half cover of the second cover is hinged to the lower half cover of the first cover.

6. The connector assembly of claim 5, further comprising first locks for holding the upper and lower half covers of the first cover together while accommodating the first connector inside and second locks for holding the upper and lower half covers of the second cover together while accommodating the second connector inside.

7. The connector assembly of claim 1, wherein the protrusions are integral with the respective upper and lower half covers of the second cover.

8. A connector assembly with a first connector, a second connector and a cover, wherein:
the first connector and the second connector are connectable to each other and completely covered by the cover in a completely connected state;
the cover includes a first cover for accommodating the first connector inside and a second cover for accommodating the second connector inside;

the second cover includes two openable and closable half covers; and each of the half covers includes a connection guaranteeing portion for contacting the second connector from behind in the completely connected state, wherein:

the second cover extends in a connecting direction along an outer surface of the second connector, and the connection guaranteeing portion includes a protrusion projecting perpendicular to the connecting direction from an inner surface of the half cover, and the protrusion has an inclined surface for pushing the second connector in an incompletely connected state toward the first connector.

* * * * *